US005102092A

United States Patent [19]

Salas

[11] Patent Number: 5,102,092

[45] Date of Patent: Apr. 7, 1992

[54] CONCRETE SHUTTERING FORM

[76] Inventor: Pierre Salas, 16, Rue Auguste Chabaud, Avignon, France, 84000

[21] Appl. No.: 364,443

[22] PCT Filed: Sep. 2, 1988

[86] PCT No.: PCT/FR88/00434

§ 371 Date: Jun. 15, 1989

§ 102(e) Date: Jun. 15, 1989

[87] PCT Pub. No.: WO89/02511

PCT Pub. Date: Mar. 23, 1989

[30] Foreign Application Priority Data

Sep. 7, 1987 [FR] France ..... 87 12365

[51] Int. Cl.[5] ..... E04G 9/06

[52] U.S. Cl. ..... 249/192; 249/44; 249/47; 249/135; 249/189

[58] Field of Search ..... 249/33, 40, 44, 47, 249/135, 189, 190, 192, 193, 194, 195, 196, 210, 216, 219.1, 219.2

[56] References Cited

U.S. PATENT DOCUMENTS

| | | | |
|---|---|---|---|
| 3,124,858 | 3/1964 | Blonde | 249/193 |
| 4,643,387 | 2/1987 | Bo | 249/193 |
| 4,744,541 | 5/1988 | Carlson et al. | 249/192 |
| 4,915,345 | 4/1990 | Lehmann | 249/196 |
| 4,957,272 | 9/1990 | Lee | 249/196 |

*Primary Examiner*—James C. Housel
*Attorney, Agent, or Firm*—Dowell & Dowell

[57] ABSTRACT

A concrete construction form including a plurality of assembled sections each having a first smooth coffering surface and a rear surface reinforced by stiffening fins oriented perpendicularly to the rear surface with elongated reinforcement gutters extending along each stiffening fin and wherein transverse girders are connected to the fins by fasteners extending through the girders and into the open ends of the gutters.

8 Claims, 5 Drawing Sheets

CONCRETE SHUTTERING FORM

BACKGROUND OF THE INVENTION

1. Field of the Invention

The present invention relates to a section constituting a concrete shuttering form element comprising a smooth coffering surface in the shutterings.

2. History of the Related Art

The forms conventionally used in concrete construction include heavy materials such as metal or an outer framework of steel or aluminium receiving a skin of plywood serving as a coffering surface. These products are generally heavy, difficult to maneuver and of limited duration. Their use necessitates considerable lifting means taking into account their weight and require particular attention in their assembly. Such a use necessitates the employment of expensive equipment as well as highly qualified manpower.

SUMMARY OF THE INVENTION

The present invention aims to propose an assembly of forms including elements which are lightweight, easily transportable, and therefore allow ease of use by non-specialized manpower and avoid having to employ inconvenient lifting means. These forms of novel design are obtained by producing elements in the form of a very light aluminium alloy which is easy to manipulate, the shape of these elements facilitating assembly to constitute a coffering surface which is easy to modulate by both lateral and vertical association of the form elements. The use of aluminium makes it possible to avoid all the problems of corrosion, hence an exceptionally long life of the product. The use of such a material therefore avoids having to use lifting means and allows simple packing when such elements are to be transported, particularly for distant public works sites.

The present invention therefore relates to a concrete form element comprising a smooth coffering surface, characterized in that the section, made by extrusion of an aluminium alloy, comprises longitudinal stiffening fins perpendicular to the coffering surface which define open cavities.

Two fins each located at one lateral end of the coffering face have a C-shaped cross-section open towards the outside of the section.

According to a first embodiment, the form element has an exterior angle made by a longitudinal central folding of the coffering surface.

According to a second embodiment, the form element has an interior angle made by a longitudinal central folding of the coffering surface and cut-out of two central fins.

According to a secondary feature of the invention, the fins comprise longitudinal reinforcements each having means for receiving a fastener acting on an element for connecting two sections.

The present invention is also directed to a form assembly for concrete comprising an association of sections as described hereinabove, characterized in that the form elements are laterally attached by a connecting element engaging in the "C" opening of a lateral fin of a first form element and in the "C" opening of a lateral fin of a second element with the connecting element being locked by members of the first and second form elements.

According to another secondary feature of this form assembly, a C-sectioned receiving element is mounted on the horizontal edges of the form elements by members cooperating with the reinforcements located on each fin.

With the invention an element for connecting two vertically superposed form elements cooperates, on the one hand, with a first receiving element mounted on the upper edge of a first form element and, on the other hand, with a second receiving element mounted on the upper edge of a second section.

According to a preferred mode of assembly, steel walers are fixed transversely on the fins of each form element section.

BRIEF DESCRIPTION OF THE DRAWINGS

A particular embodiment of the invention will now be described in greater detail, which will show more clearly the essential features and advantages, it being understood, however, that this embodiment has been chosen by way of example and that it is in no way limiting. Its description is illustrated by the accompanying drawings, in which.

DESCRIPTION OF THE PREFERRED EMBODIMENT

Figure 1:
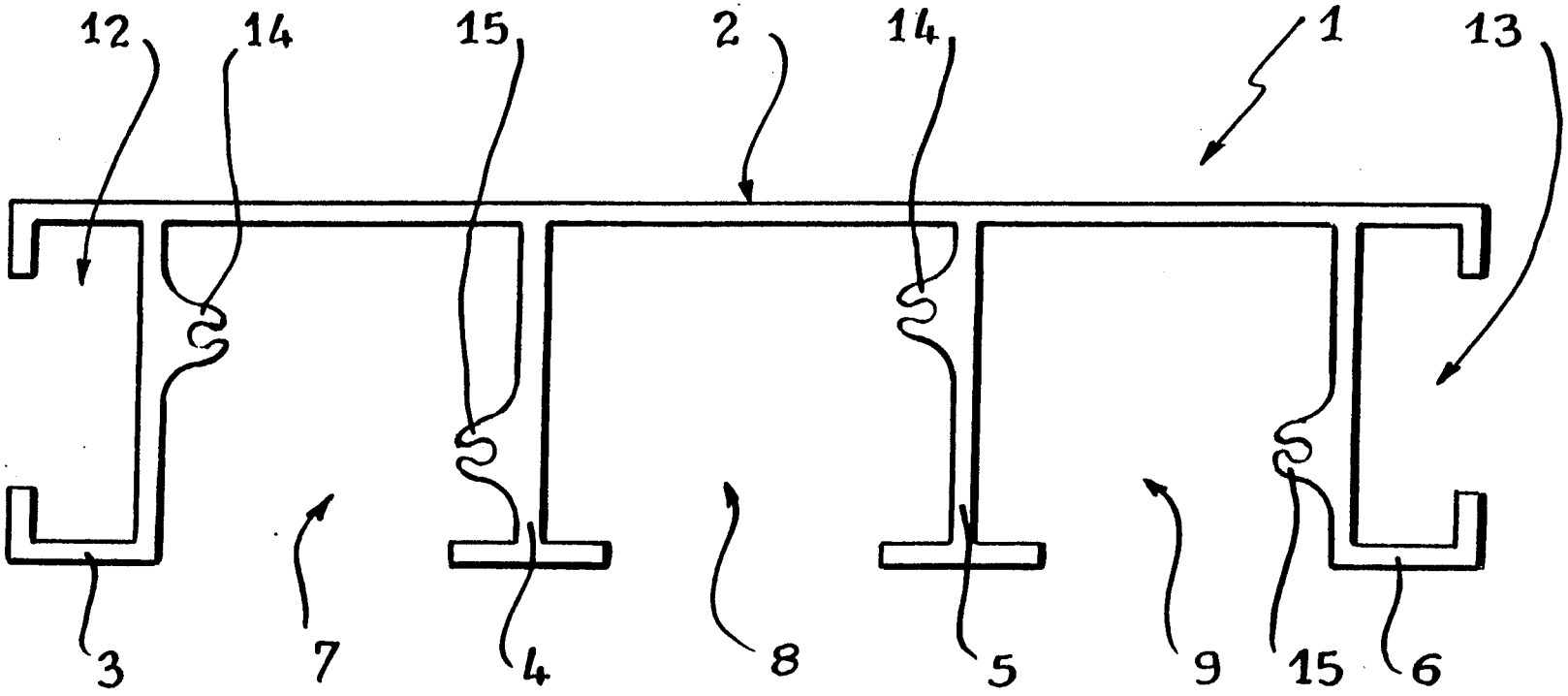
FIG. 1 is a view in transverse section of a form element of the present invention.
Figure 8:
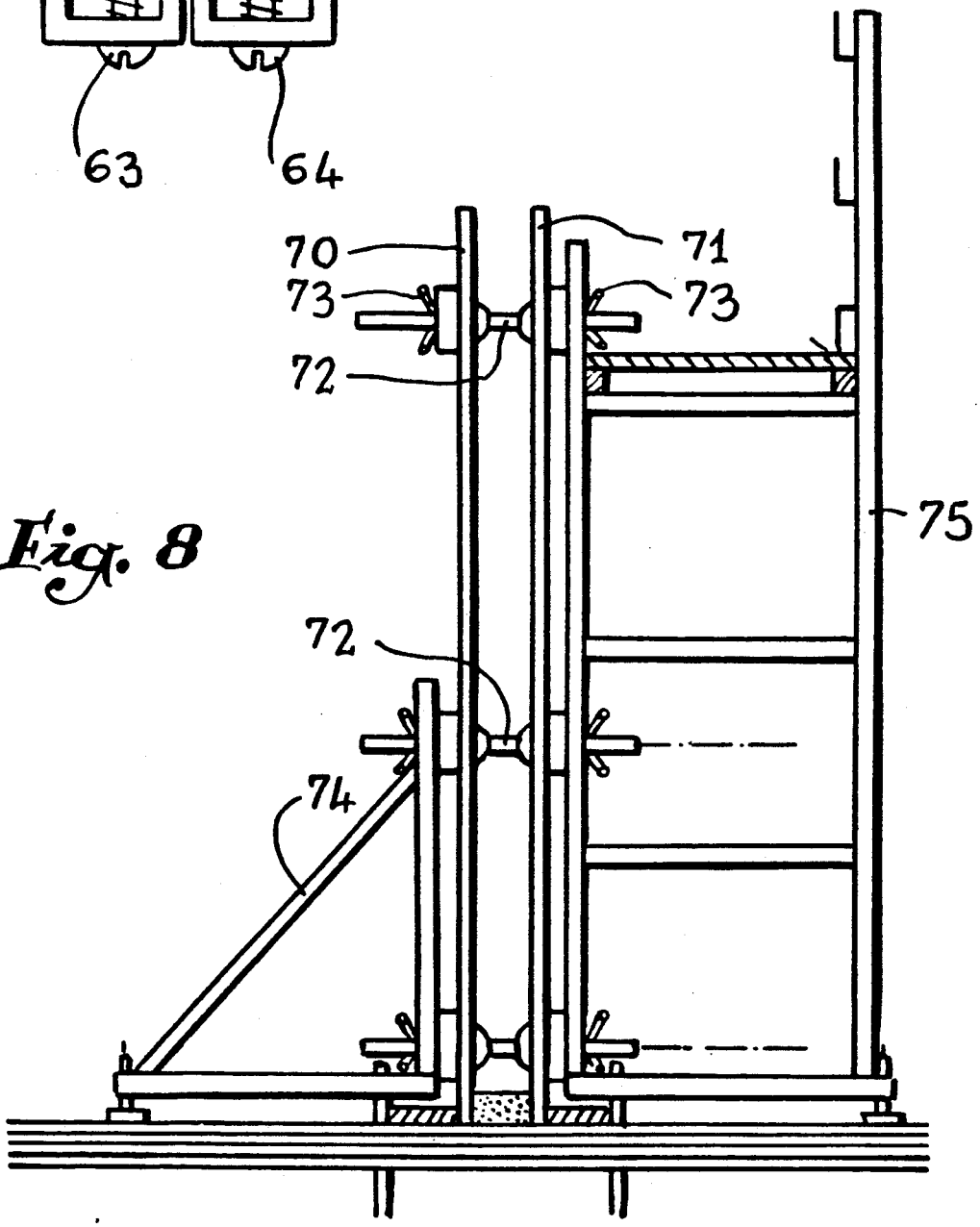
FIG. 8 is a side view of an assembly using the form elements of the present invention.

FIG. 1 shows in section a concrete form element 1 of which the particular shape allows an easy assembly used for pouring the wall of the building such as shown in FIG. 8. The assembly comprises two forms 70, 71 of which the coffering faces are opposed. These two forms are positioned with the aid of rods 72 passing through the two surfaces to maintain a constant spacing between the surfaces of each form element.

Each part of the form element comprises lateral and vertical sections which will now be explained in detail.

The section shown in FIG. 1 is made by extrusion from an aluminium alloy giving it a lightweight which facilitates handling. The press used during the extrusion makes it possible to obtain a section shape whose characteristics and advantages will be described.

The form section comprises a flat face 2, 2.5 mm thick. Perpendicularly to this surface are located longitudinal stiffening fins 3, 4, 5, 6. In a preferred embodiment, the width of the section will present a form surface of 20 cm. For such a width, the section will be provided with four fins in the form of two lateral fins 3, 6 at each end and two central fins 4, 5. The central fins 4, 5 have a "T"-section of which the foot extends from the form surface and of which the ends which are constituted by the head bar of the "T" are parallel to the form surface in the same plane as the two ends of the lateral fins. The two lateral fins 3, 6 present a C-section, the opening being oriented laterally towards the outside on the edge of the section. It will be understood that the number of central stiffening fins may vary if the dimensions of an element are enlarged in order that the fins are regularly spaced apart to give the assembly resistance and to limit the forces applied on the form surface. The production by extrusion of two lateral fins and of two central fins makes it possible to define open cavities 7, 8, 9 of which the openings are located on the face of the section opposite the form surface in alignment with the rear ends of the two fins 3, 6. The lateral fins 3, 4 of "C" section are cast so that their opening 12, 13 is oriented towards the outer edge of the section.

In a preferred embodiment, a form element as shown in section in FIG. 1 has a height of 2.50 m, a width of 20 cm and an edge thickness of 5 cm. This section is furthermore provided with longitudinal reinforcements 14, 15 each located on a fin, constituting a gutter performing two functions: on the one hand an additional mass for at limiting the forces applied to the element and thus avoiding any rupture and, on the other hand, to allow by the end openings of the gutter the introduction of fastening means such as screws to ensure positioning of another form section which will be explained hereinbelow. These longitudinal reinforcements are alternately offset in the succession of fins so that, when the adjacent section is placed on the edge of this section, fasteners, then engaged in the gutters, are not aligned and therefore offset the pressure exerted on the section.

The production of such an element for dimensions cited hereinabove makes it possible to obtain, by the use of aluminium, a weight of 3.5 kg, which implies a light, easily maneuverable element, unique up to the present time in the domain of concrete forms. Moreover, the use of aluminium avoids any problem of corrosion thus giving the element an exceptionally long life.

Figure 2:
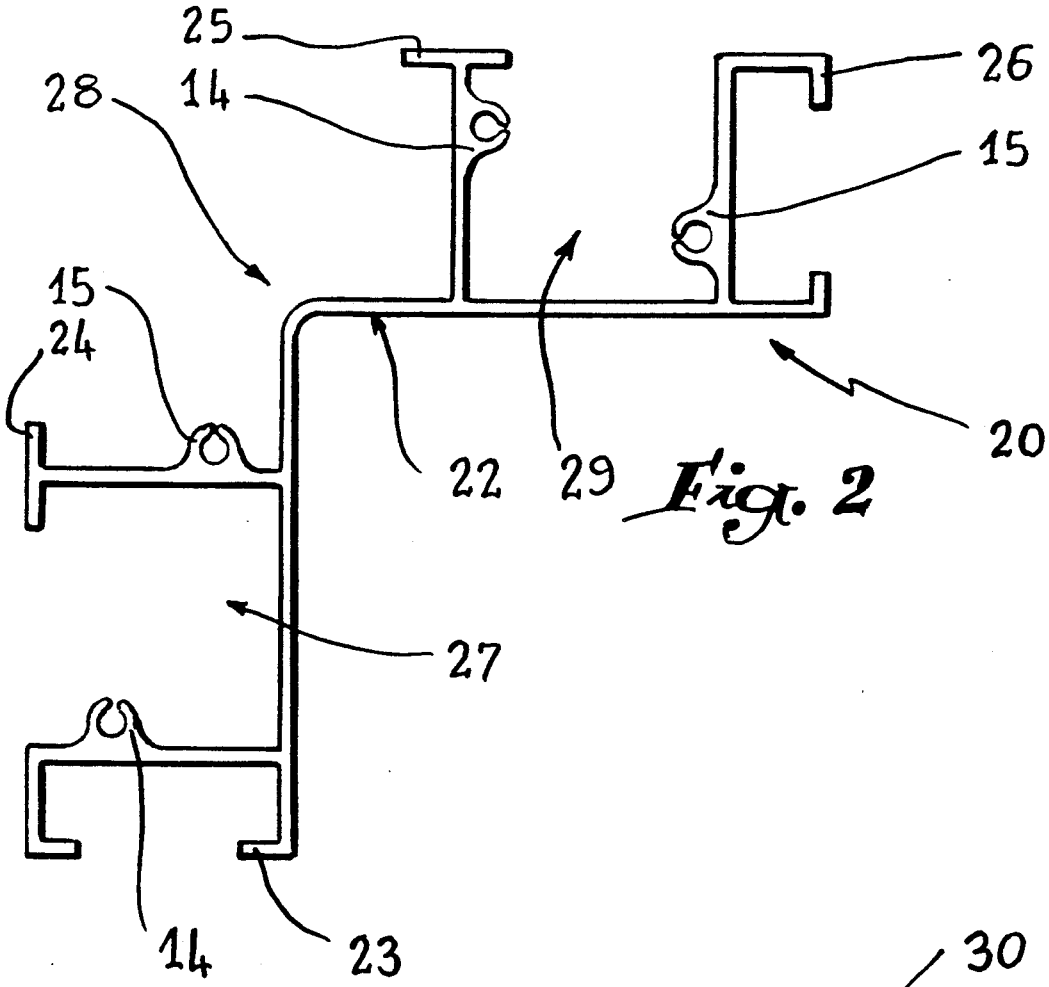
FIG. 2 is a view in section of a form element having an exterior angle.

From such a basic element, complementary form elements may be obtained by a simple operation, such as in particular sections for obtaining exterior or interior angles. With reference to FIG. 2, a form element section making an exterior angle 20 is obtained by folding longitudinally to the center of the form surface. This middle of the form surface lies in the central cavity 28 and the center of the form surface coincides with the edge of the 90° angle formed by folding the form surface 22. The two lateral fins 23, 26 still have their opening towards the outside of the edge of the section. The cavities 27 and 29 have not been modified, only the cavity 28 defined by the central fins 24, 25 has had its volume increased. The longitudinal reinforcements 14, 15 are also found in the same manner as set forth hereinabove.

Figure 3:
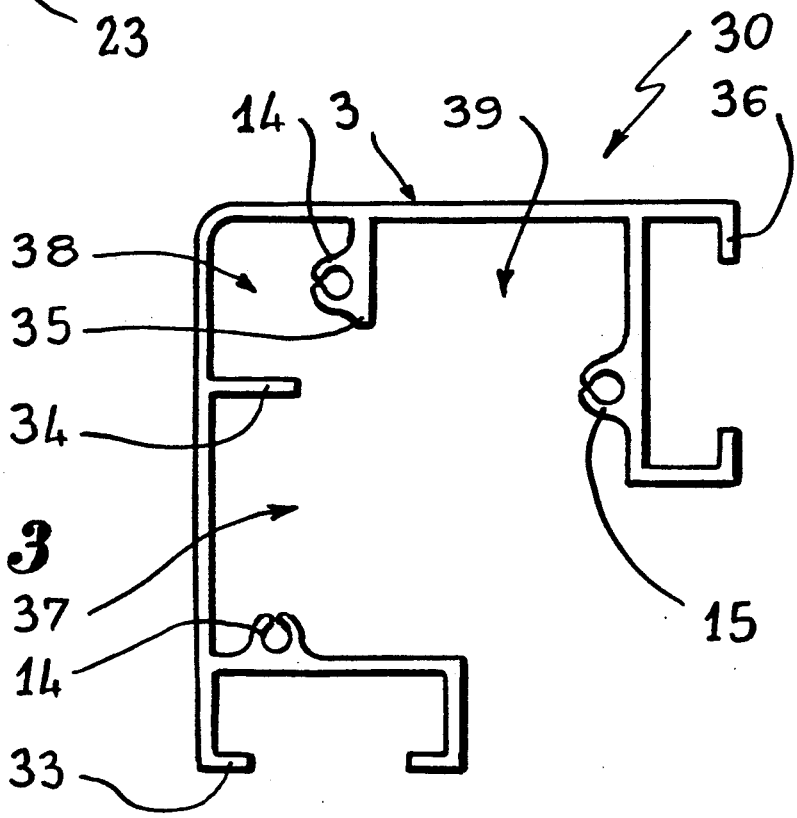
FIG. 3 is a view in section of a form element having an interior angle.

FIG. 3 presents a form element section 30 making an interior angle. This angle element is made from the basic element set forth hereinabove, by folding the median part longitudinally of the form surface but as in the case of an exterior angle, a folding involving a 90° approach of the two faces making the angle; however, in such case, it is a question of a 90° spacing of the two faces involving a movement of approach of the two lateral fins. In order to obtain a folding towards the rear part of the section with reference to the support of the fins, it is necessary to prepare, by cut-out, the two central fins so that they do not come into abutment against each other. Such cut-out is effected at the level of the middle of the two central "T"-shaped fins so that, when the section is folded towards the inside, the two remaining fin parts 34, 35 do not block the movement. An interior angle for the form is then produced by cut-out and folding. The prior cut-out of the fins involves an elimination of the fin 34 of the gutter for insertion of the fasteners, but a longitudinal reinforcing gutter 14 is maintained on the fin 35. The two lateral C-sectioned fins are intact and their openings on the edge are oriented at 90° with respect to each other.

From the basic element delivering a rectilinear smooth form surface, form element sections may easily be obtained for particular applications such as corner forms. This passage from the basic element is easily effected by a simple folding and possibly cut-out of the fins.

Of course, in the description of FIGS. 2 and 3, the transformation was described for obtaining a right-angled form, but it may be readily understood that it would be possible to obtain an intermediate obtuse or acute angle by limiting the approach by folding of the two ends of the section.

From a form element section as previously described, large surfaces are easily obtained by lateral association and by superposition of these different elements.

Figure 4:
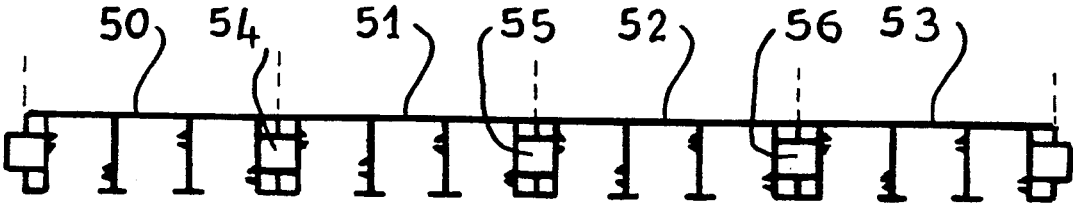
FIG. 4 is a view in section of laterally fastened form elements.
Figure 7:
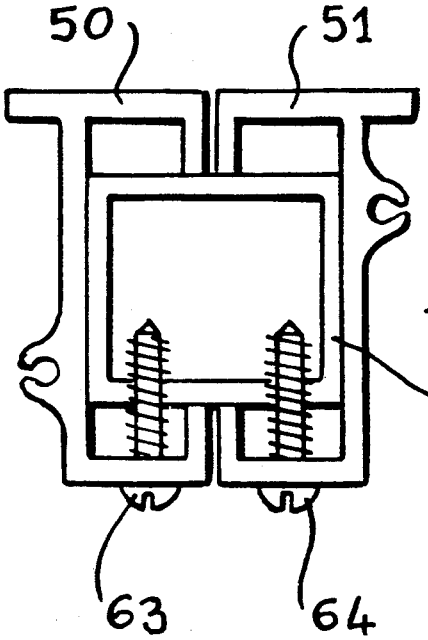
FIG. 7 is a view of the cooperation of elements for connection between two fastened form elements.

FIG. 4 shows in section a lateral association of these various elements. The elements 50, 51, 52, 53 are laterally joined to one another so that their surface is in the same plane. A lateral fin of a first element cooperates with a lateral fin of a second element so that their openings are opposite. When these lateral fins are joined, a closed volume is obtained in which is inserted a connecting element 54, 55, 56 formed by an aluminium section of square cross-section. FIG. 7 shows the cooperation between this connecting element and the ends of two sections in which it is inserted. A first section 50 is joined by its lateral fin to a second section 51 at its lateral fin. A connecting element 62 is inserted, which is blocked, on the one hand at the bottom of the cavity against the fins and, on the other hand, laterally by the return flanges of the C-section, avoiding any front-to-rear clearance. Once this connecting element is inserted in the two cavities of the lateral fins of the sections 50, 51, the connecting element is fixed by screws 63, 64 to the two form element sections.

In a preferred embodiment, the fasteners 63, 64 will pass through the rear surface of the form element in order to reach the connecting element 62.

Figure 5:
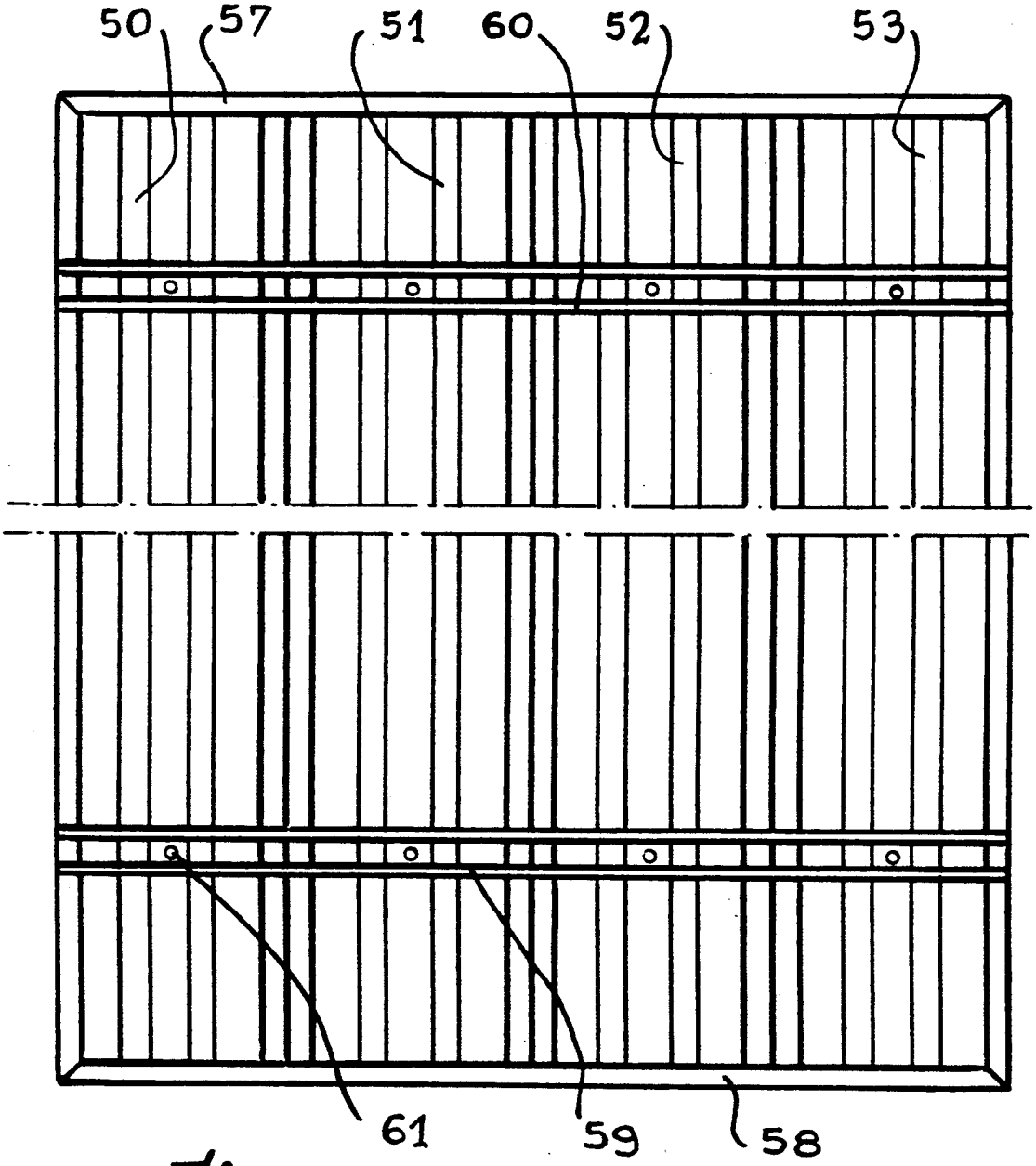
FIG. 5 is a front view of fastened form elements.

FIG. 5 shows an assembly of form element sections 50, 51, 52, 53 joined to one another, as seen in section in FIG. 4.

Figure 6:
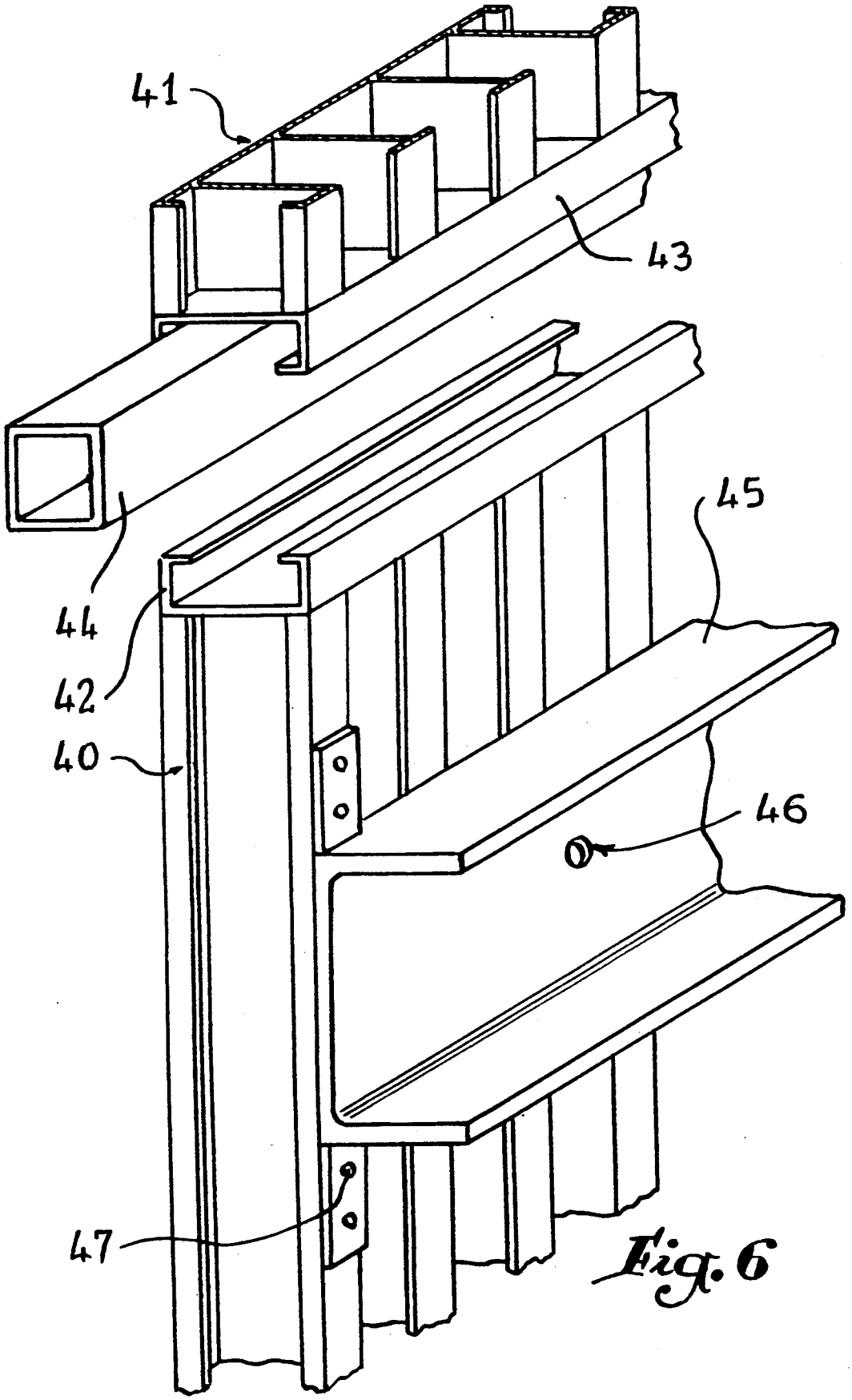
FIG. 6 is a perspective view of the superposed cooperation of form elements.

Referring now to FIG. 6, the manner of associating a vertical arrangement the sections on one another will be discussed. To that end, a receiving channel 42 made by an aluminium section of "C" cross-section, is placed horizontally on the upper edge of a first section. On the rear inner face of this "C" section, the receiving channel is provided with orifices allowing the passage of fasteners which are engaged in the longitudinal reinforcements located on each fin. The fasteners may, for example, be screws. The positioning of this receiving channel on the upper edge of the element allows, on the one hand, a rigidification of the assembly and, on the other hand, reconstitutes a shape of the section comparable to that located laterally on the section. On the form element which will be joined in superposition on the first element previously described, a receiving element or channel 43 comprising the same C cross-section will be fixed on the lower edge of the section. When the receiving elements 42, 43 are placed on the lower and upper edges of the two form channels to be joined, a connecting element 44 is engaged in the opening made by the "C" shape of the first section and, in the same manner as described previously for lateral joints, this connecting element cooperates with the other opening of the receiving element associated in the vertical cooperation. All that will remain, for a definitive assembly of the two elements, is to place screws traversing the base of the "C" section channels and the connecting element. In the case of a form element section for an interior or exterior angle, it will be readily understood that the connecting element has a square shape as well as the section making the receiving channel so as to allow a corner cooperation of the two superposed form elements. A form may therefore be easily made by lateral association of a basic element as well as by vertical association. When the totality of the shuttering surface required has been produced, steel walers 45 are positioned on the rear face of the form element sections by securing the "T"-shaped stiffening fins with the aid of screws 47.

Referring again to FIG. 5, it is seen that these steel walers 59, 60 cooperate laterally with the assembly of the joined form element sections. These walers 59, 60 include openings for passage of spacing elements coinciding with the orifices made in the cavities defined by stiffening fins. The upper edge of the form made is defined by a receiving element 57 and the lower edge by another receiving element 58.

The present invention therefore makes it possible to produce form element sections entirely of aluminium, benefitting from a total weight of 19 kg to the $m^2$ and responding to all uses and needs in building and public works, not requiring the use of machines since they can be manipulated by hand. The use of aluminium avoids all the problems of corrosion and therefore implies an exceptionally long useful life. The easy assembly with the aid of the connecting elements and the receiving sections allows use by unqualified manpower. The particular shape of the different elements automatically ensures square levelling and vertical orientation. The shape of these elements further allows easy packing and transport in container form. These forms therefore benefit from a mechanical assembly within reach of all, thus avoiding the servitudes of a conventional assembly employing sophisticated welding and complicated manufacturing techniques.

Of course, the invention is in no way limited by the particular features which have been set forth in the foregoing or by the details of the particular embodiment chosen to illustrate the invention. Variations may be made to the particular embodiment which has been described by way of example and to its elements without departing from the scope of the invention.

I claim:

1. A lightweight metallic concrete construction form comprising, at least one section having a generally smooth front surface, a rear surface and opposite sides, a plurality of spaced first stiffening fins extending outwardly generally perpendicularly from said rear surface and having opposite ends, one of said first stiffening fins being located adjacent to and spaced inwardly of each of said sides of said section, each of said sides thereby defining outwardly oriented open channels, each of said first stiffening fins including a longitudinal reinforcement gutter disposed thereon which is open adjacent said opposite ends of said first stiffening fins, a pair of transverse girders, and securing means extending through said transverse girders and into said reinforcement gutters for securing said transverse girders to said opposite ends of said first stiffening fins.

2. The lightweight metallic concrete construction form of claim 1 wherein said outwardly oriented open channels have a cross-sectional configuration and said transverse girders having the same cross-sectional configuration as said channels.

3. The lightweight metallic concrete construction form of claim 1 wherein said front surface of said section includes two portions which are oriented outwardly at an oblique angle with respect to one another, at least two second stiffening fins extending outwardly generally perpendicularly from said rear surface and having opposite ends, said second stiffening fins extending outwardly a lesser distance from said rear surface than said first stiffening fins and being spaced intermediate said first stiffening fins, and at least one of said second stiffening fins including a second longitudinal reinforcement gutter which is open at said opposite ends of said second stiffening fins.

4. The lightweight metallic concrete construction form of claim 1 in which said section includes first and second portions which are oriented at an angle not exceeding approximately 90° with respect to one another.

5. The lightweight metallic concrete construction form of claim 1 in which said reinforcement gutters extending along said first stiffening fins are positioned at different distances from said rear surface of said section.

6. The lightweight metallic concrete construction form of claim 1 including a plurality of said sections, a connecting element engageable within said outwardly oriented open channels between two adjacent sections and fastening means extending through said channels of said sections and through said connecting elements for assembling said connecting elements to said channels of said sections.

7. The lightweight metallic concrete construction form of claim 6 in which said transverse girders include outwardly oriented generally C-shaped openings, secondary connection elements seated within said C-shaped openings of two adjacent sections and means for securing said secondary connecting elements within and to said transverse girders.

8. The lightweight metallic concrete construction form of claim 7 including at least one waler extending transversely of said first stiffening fins, and means for securing said at least one waler to said first stiffening fins along said rear surface of said sections.

* * * * *